US011768460B2

(12) United States Patent
Okawa et al.

(10) Patent No.: US 11,768,460 B2
(45) Date of Patent: Sep. 26, 2023

(54) IMAGE FORMING APPARATUS

(71) Applicant: CANON KABUSHIKI KAISHA, Tokyo (JP)

(72) Inventors: Yuichiro Okawa, Tokyo (JP); Yu Shuhama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/368,629

(22) Filed: Jul. 6, 2021

(65) Prior Publication Data

US 2021/0333754 A1 Oct. 28, 2021

Related U.S. Application Data

(62) Division of application No. 17/038,146, filed on Sep. 30, 2020, now Pat. No. 11,092,928.

(30) Foreign Application Priority Data

Oct. 1, 2019 (JP) ..... 2019-181252

(51) Int. Cl.
*G03G 21/20* (2006.01)

(52) U.S. Cl.
CPC ..... *G03G 21/206* (2013.01)

(58) Field of Classification Search
CPC ..... G03G 21/206; G03G 21/1619; G03G 2221/1645; G03G 2221/1678
See application file for complete search history.

(56) References Cited

U.S. PATENT DOCUMENTS

| | | | | |
|---|---|---|---|---|
| 6,308,024 | B1 | 10/2001 | Nakayama et al. | 399/98 |
| 7,787,003 | B2 | 8/2010 | Sowa et al. | B41J 2/385 |
| 7,877,037 | B2 | 1/2011 | Igarashi | G03G 21/20 |
| 8,693,915 | B2 | 4/2014 | Nozaki et al. | G03G 21/20 |
| 8,873,994 | B2 | 10/2014 | Nakazawa et al. | G03G 21/20 |
| 9,791,830 | B2 | 10/2017 | Fujiya et al. | G03G 21/20 |
| 11,092,928 | B2 * | 8/2021 | Okawa | G03G 21/1814 |
| 2007/0146739 | A1 * | 6/2007 | Igarashi | G03G 21/206 358/1.7 |
| 2011/0280609 | A1 * | 11/2011 | Nakazawa | G03G 21/206 399/92 |
| 2012/0219314 | A1 | 8/2012 | Nozaki et al. | 399/92 |

(Continued)

FOREIGN PATENT DOCUMENTS

| | | |
|---|---|---|
| JP | H07-301977 | 11/1995 |
| JP | 2004-226806 | 8/2004 |

(Continued)

OTHER PUBLICATIONS

Office Action dated Jun. 27, 2023 in counterpart Japanese Application No. 2019-181252, together with English translation thereof.

*Primary Examiner* — Thomas S Giampaolo, II
(74) *Attorney, Agent, or Firm* — Venable LLP

(57) ABSTRACT

An image forming apparatus includes a first frame member, a second frame member opposing the first frame member, a cartridge, a cartridge holding member, an air blowing portion, a first opening, a second opening opposing the first opening, an air discharge passage member, and an outer casing member provided so as to cover an outside of the second frame member and permitting discharge of the air to an outside of the image forming apparatus through the air discharge passage member.

10 Claims, 10 Drawing Sheets

(56) References Cited

U.S. PATENT DOCUMENTS

| | | | | |
|---|---|---|---|---|
| 2014/0140719 | A1 | 5/2014 | Suzuki | 399/92 |
| 2017/0160699 | A1 | 6/2017 | Imanari et al. | G03G 21/206 |
| 2021/0096510 | A1 | 4/2021 | Yuzawa et al. | G03G 21/206 |

FOREIGN PATENT DOCUMENTS

| | | |
|---|---|---|
| JP | 2006-315311 | 11/2006 |
| JP | 2007-178608 | 7/2007 |
| JP | 2008-020809 | 1/2008 |
| JP | 2011-237640 | 11/2011 |
| JP | 2012-194527 | 10/2012 |
| JP | 2016-206397 | 12/2016 |

* cited by examiner

IMAGE FORMING APPARATUS

This application is a division of application Ser. No. 17/038,146 filed Sep. 30, 2020, currently pending; and claims priority under 35 U.S.C. § 119 to Japan Application No. 2019-181252 filed in Japan on Oct. 1, 2019; the contents of all of which are incorporated herein by reference as if set forth in full.

FIELD OF THE INVENTION AND RELATED ART

The present invention relates to an image forming apparatus such as a copying machine, a printer or a facsimile machine.

In recent years, an air passage constitution of the image forming apparatus such as the printer or the facsimile machine has been required to supplies the air to an object such as a cartridge requiring cooling and required to discharge the air to an outside of the image forming apparatus.

For example, a constitution in which a fan which is an air blowing machine for discharging the air in the neighborhood of a fixing device for fixing an image on a sheet by heating is provided and cools the air at a periphery of the fixing device has been known (Japanese Laid-Open Patent Application (JP-A) 2004-226806).

Further, in a conventional image forming apparatus, an air communication port for permitting cooling of an inside of a casing of the image forming apparatus is provided in a side surface of the image forming apparatus. For example, a constitution in which in order to make the air communication port hardly visible from a user, the air communication port is disposed on a top surface side of a handle portion held by hands of the user when the user raises the image forming apparatus has been known (JP-A 2008-20809).

In this constitution, the fan which is the air blowing machine is mounted in the image forming apparatus, and the air in the image forming apparatus is discharged to an outside of the image forming apparatus through the air communication port (air discharge port) provided in the side surface of the image forming apparatus, so that an inside of the casing of the image forming apparatus is cooled. However, when the air in the image forming apparatus is discharged by the fan to the outside of the image forming apparatus through the air communication port (air discharge port) provided in the side surface of the image forming apparatus, the outside air of the image forming apparatus is sucked into the image forming apparatus through a sheet discharge opening and a gap between the casing and a cover for opening and closing a dismounting opening of the cartridge, and the like. There is a possibility that the air sucked in the image forming apparatus through the sheet discharge opening and the gap of the image forming apparatus, and the like passes through a sheet feeding passage and the fixing device in a process in which the air reaches the air communication port (air discharge port) provided in the side surface of the image forming apparatus. In this case, when the air flows to an inside of the fixing device, there is a possibility that ultrafine particles (UFP) liable to generate when toner is heated at a high temperature and is fixed on the sheet are discharged to the outside of the image forming apparatus.

SUMMARY OF THE INVENTION

A principal object of the present invention is to provide an image forming apparatus capable of supplying air, sucked in the image forming apparatus, to an object requiring cooling and capable of discharging the air to an outside of the image forming apparatus without supplying the air to an unnecessary place.

According to an aspect of the present invention, there is provided an image forming apparatus comprising: a first frame member provided on one side in a first direction; a second frame member provided on the other side in the first direction so as to oppose the first frame member; a cartridge provided between the first frame member and the second frame member and including a drum container containing a photosensitive drum and a developing container containing a developing roller configured to develop an electrostatic latent image formed on the photosensitive drum; a holding member provided between the first frame member and the second frame member and configured to hold the cartridge; air blower provided on the first frame member and configured to supply air from the one side to the other side in a space defined by the drum container, the developing container and the photosensitive drum of the cartridge; a first opening provided on the other side of the holding member and configured to permit the air to be supplied from the air blower through the space; a second opening provided in the second frame member and opposing the first opening with respect to the first direction; an air discharge passage member configured to guide the air supplied through the second opening; and an outer casing member provided so as to cover an outside of the second frame member and configured to permit discharge of the air to an outside of the image forming apparatus through the air discharge passage member.

Further features of the present invention will become apparent from the following description of exemplary embodiments with reference to the attached drawings.

Figure 2:
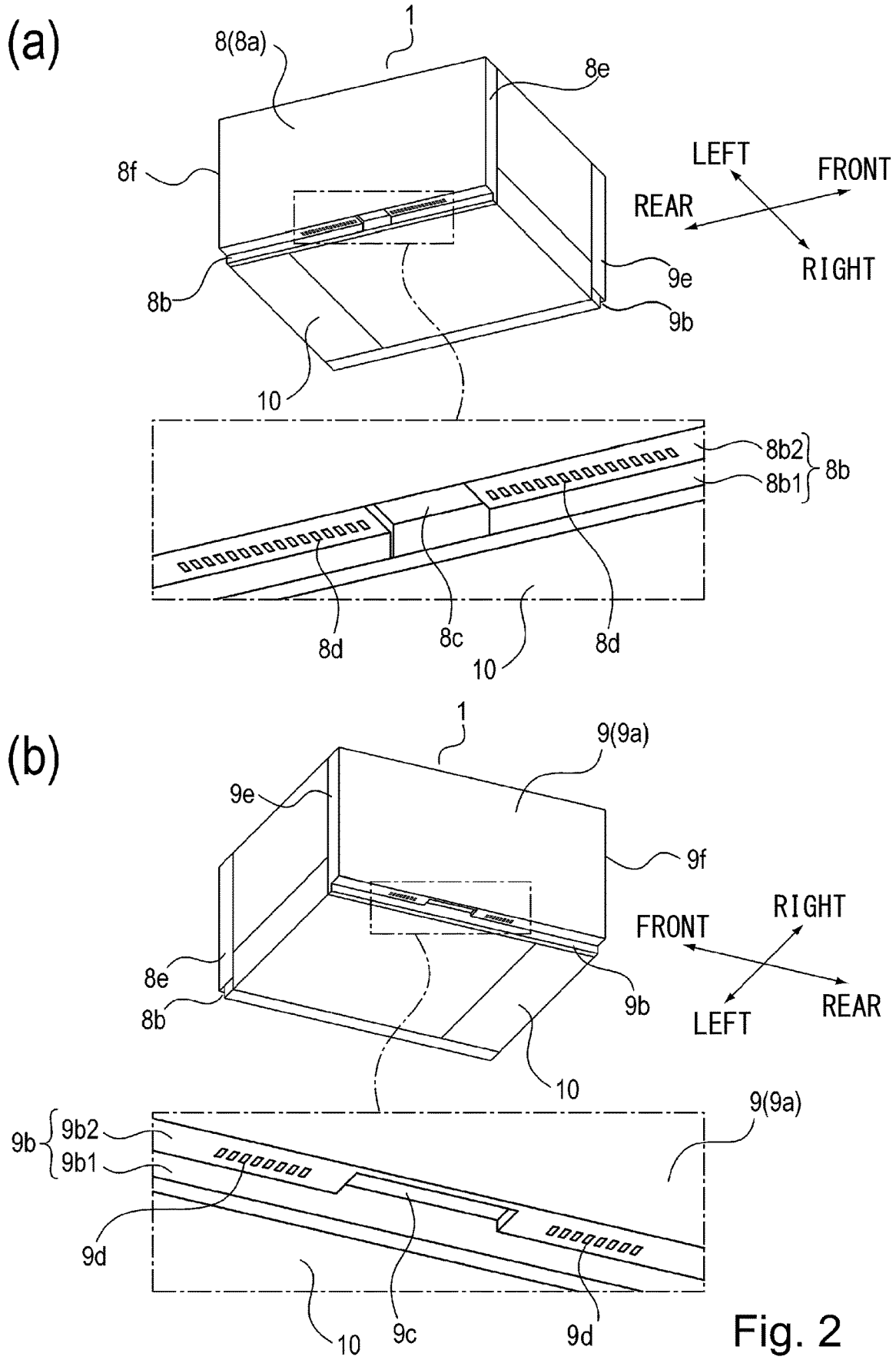

Parts (a) and (b) of FIG. 2 are perspective views showing the image forming apparatus as seen from a bottom of the image forming apparatus.

Figure 3:
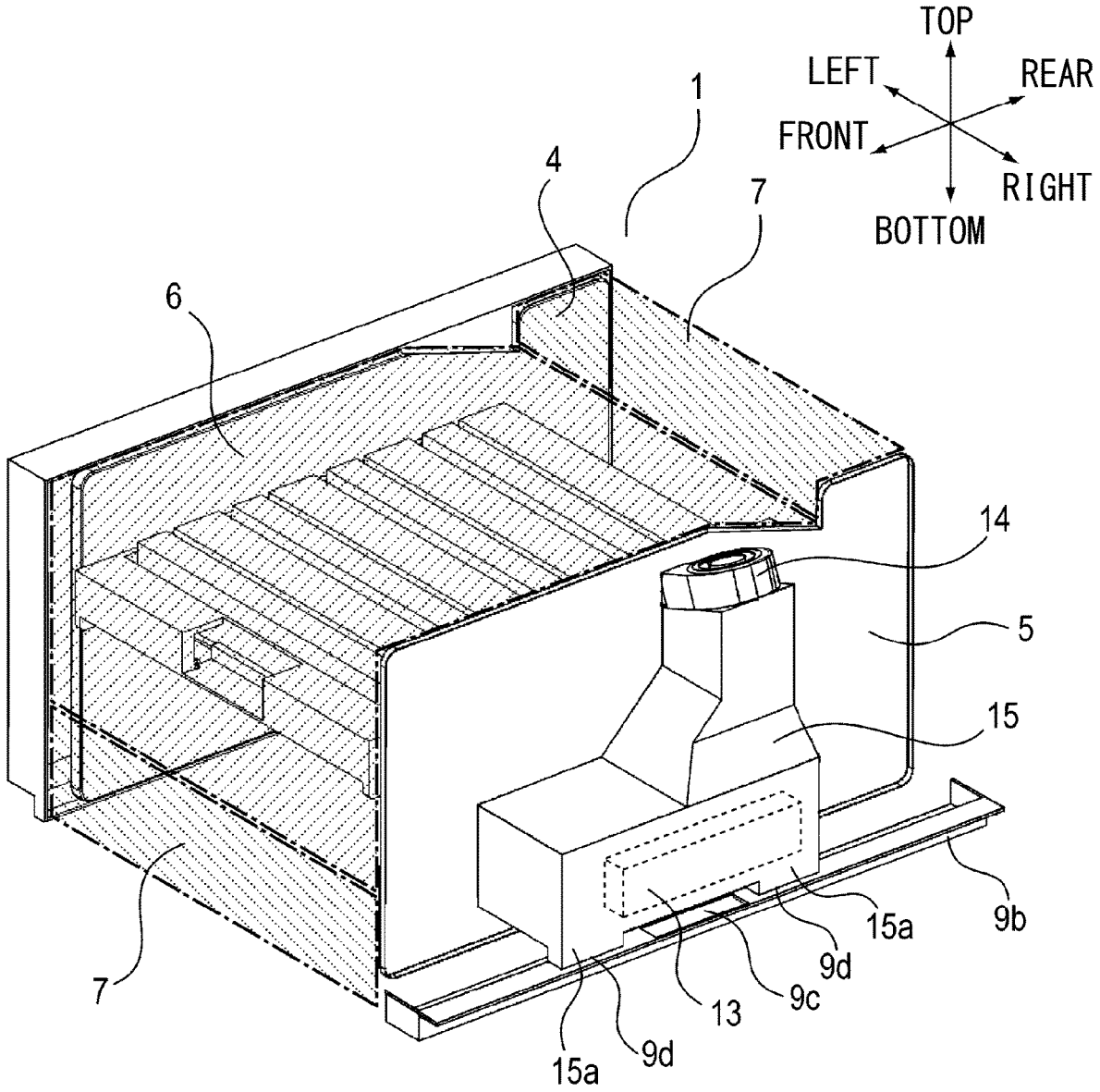

FIG. 3 is a perspective view of the image forming apparatus in a state in which an outer casing other than an offset portion is indicated by a hatched dotted line.

Figure 4:
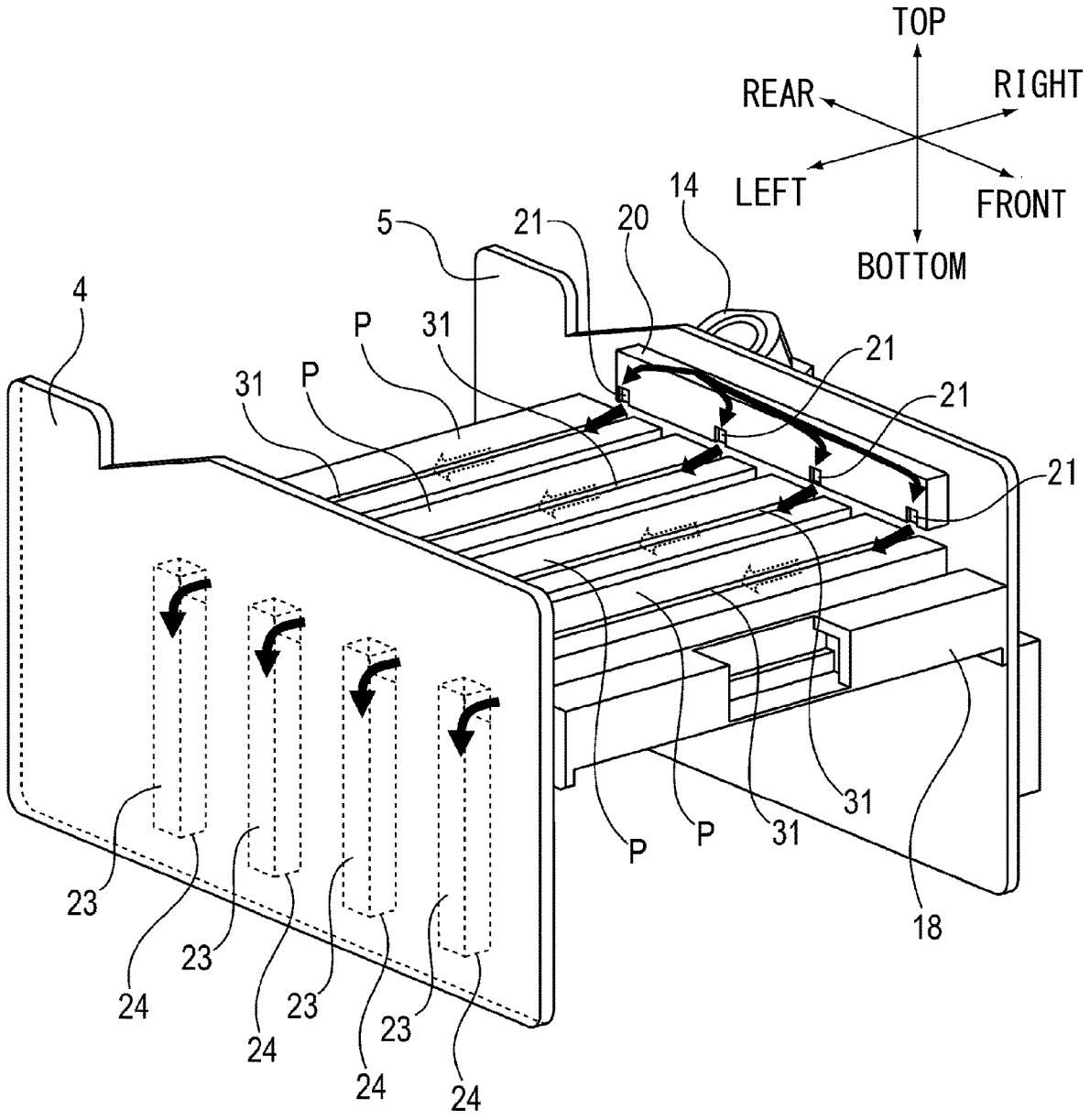

FIG. 4 is a perspective view of an air blowing passage of the image forming apparatus in a state in which an outer casing cover is not shown.

Figure 5:
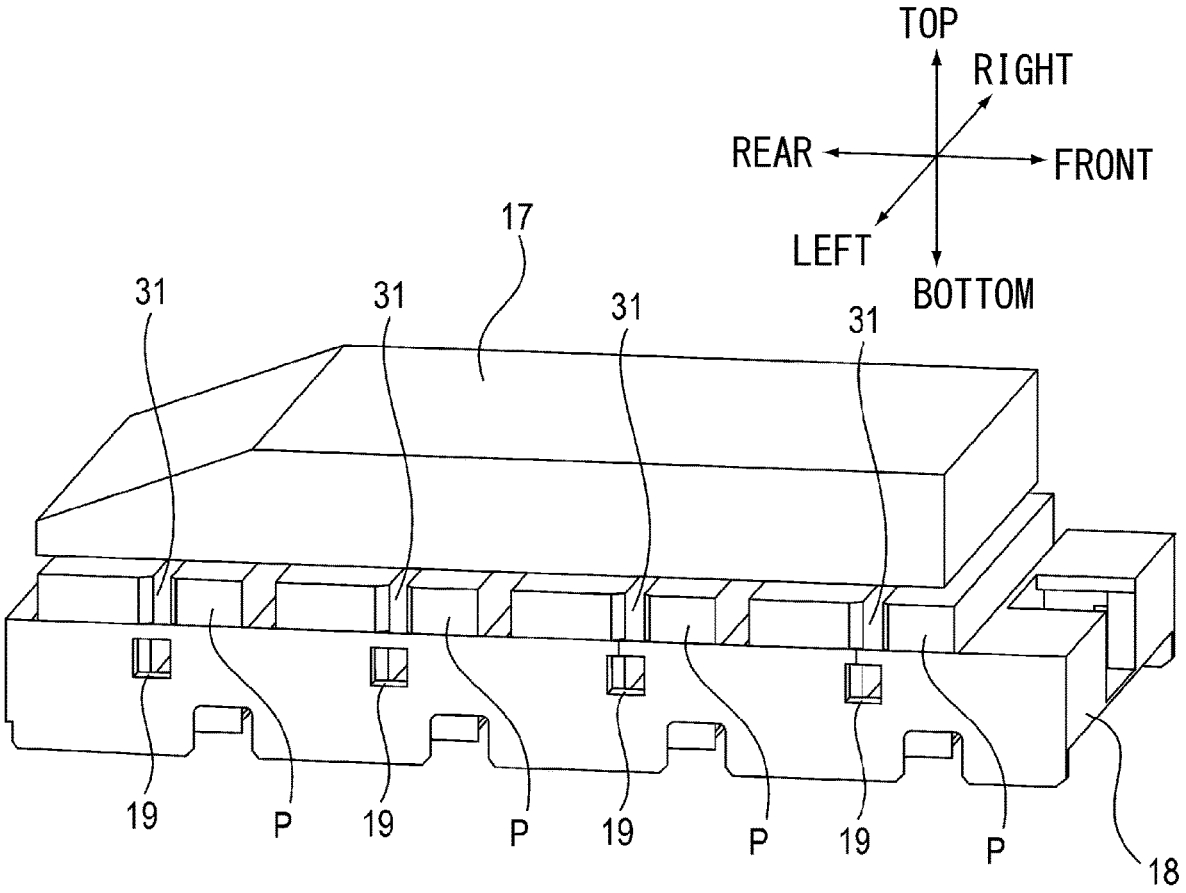

FIG. 5 is a perspective view of a cartridge tray holding cartridges and a laser scanner unit.

Figure 6:
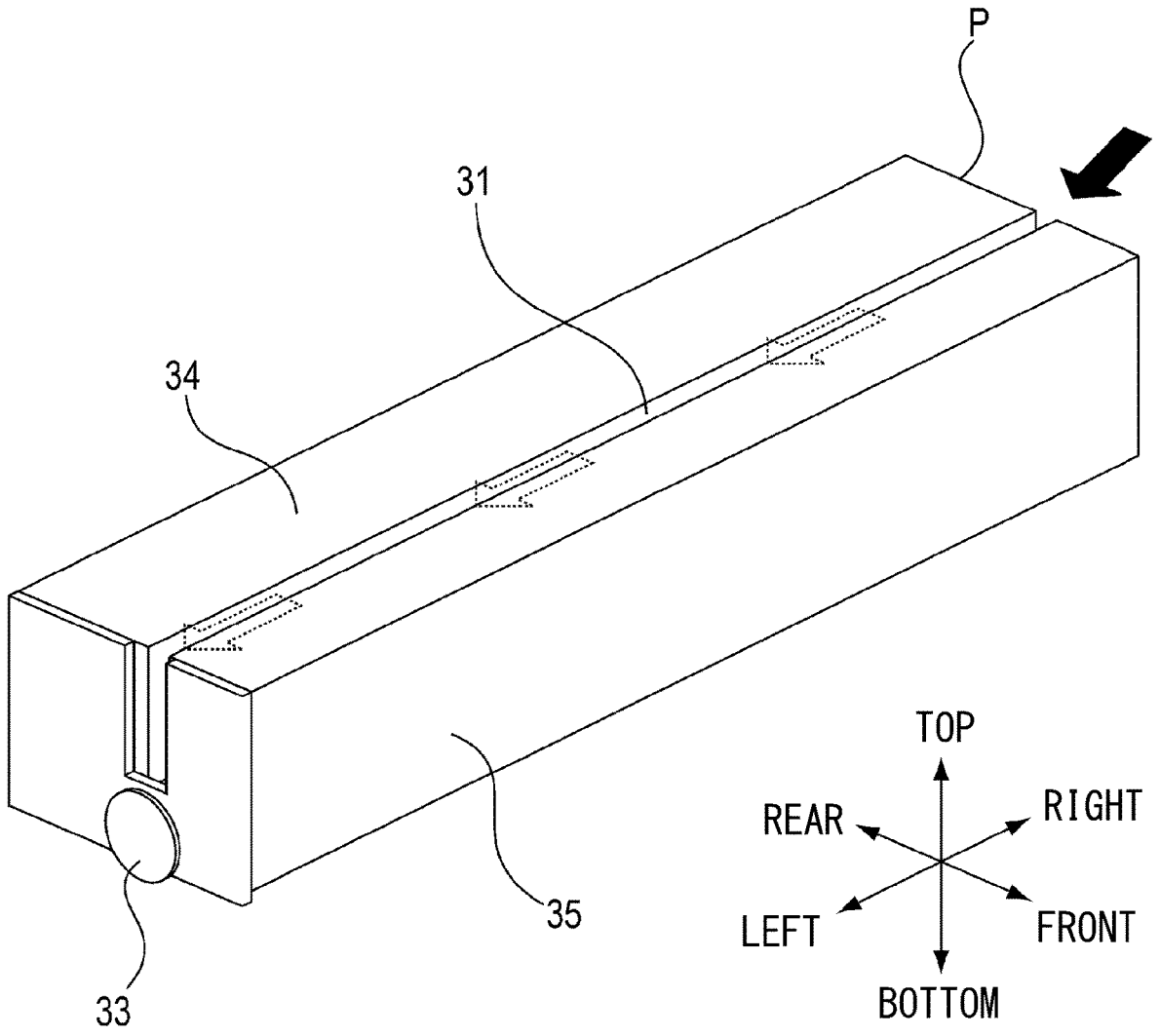

FIG. 6 is a perspective view of the cartridge which is an object requiring cooling.

Figure 7:
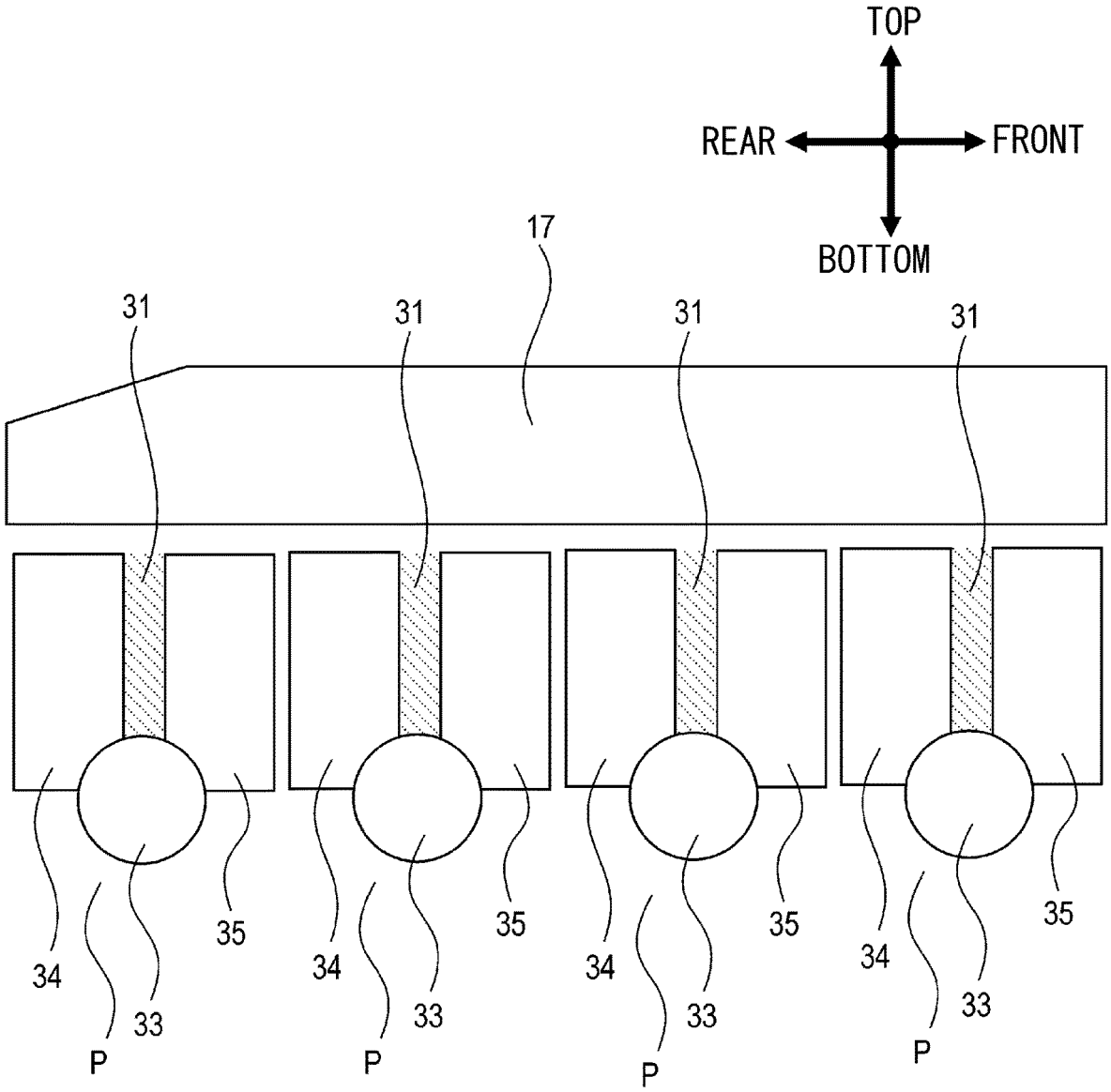

FIG. 7 is a schematic view of the cartridges and the laser scanner unit.

Figure 8:
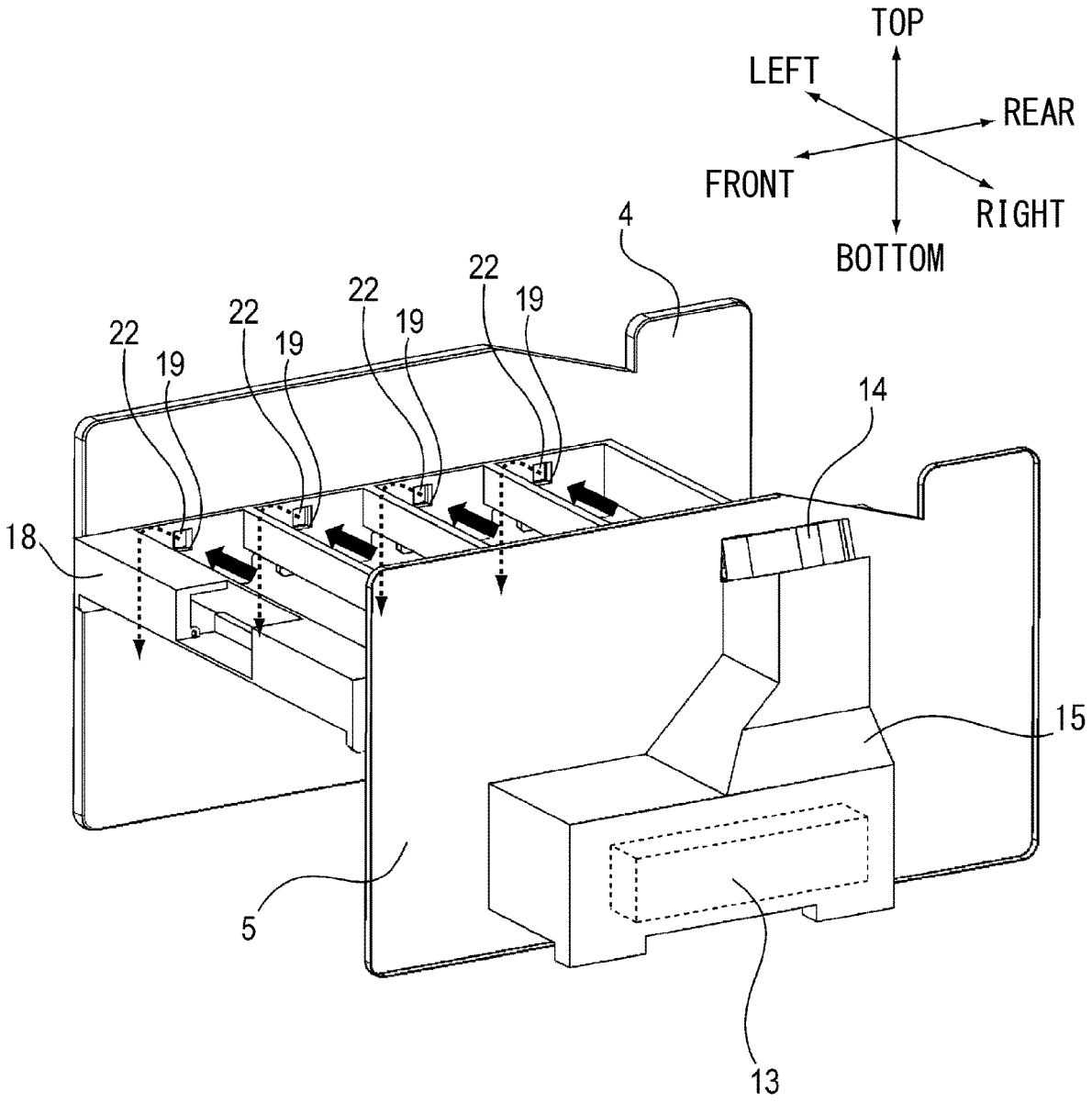

FIG. 8 is a perspective view of the air blowing passage of the image forming apparatus in the state in which the outer casing cover is not shown.

Figure 1:
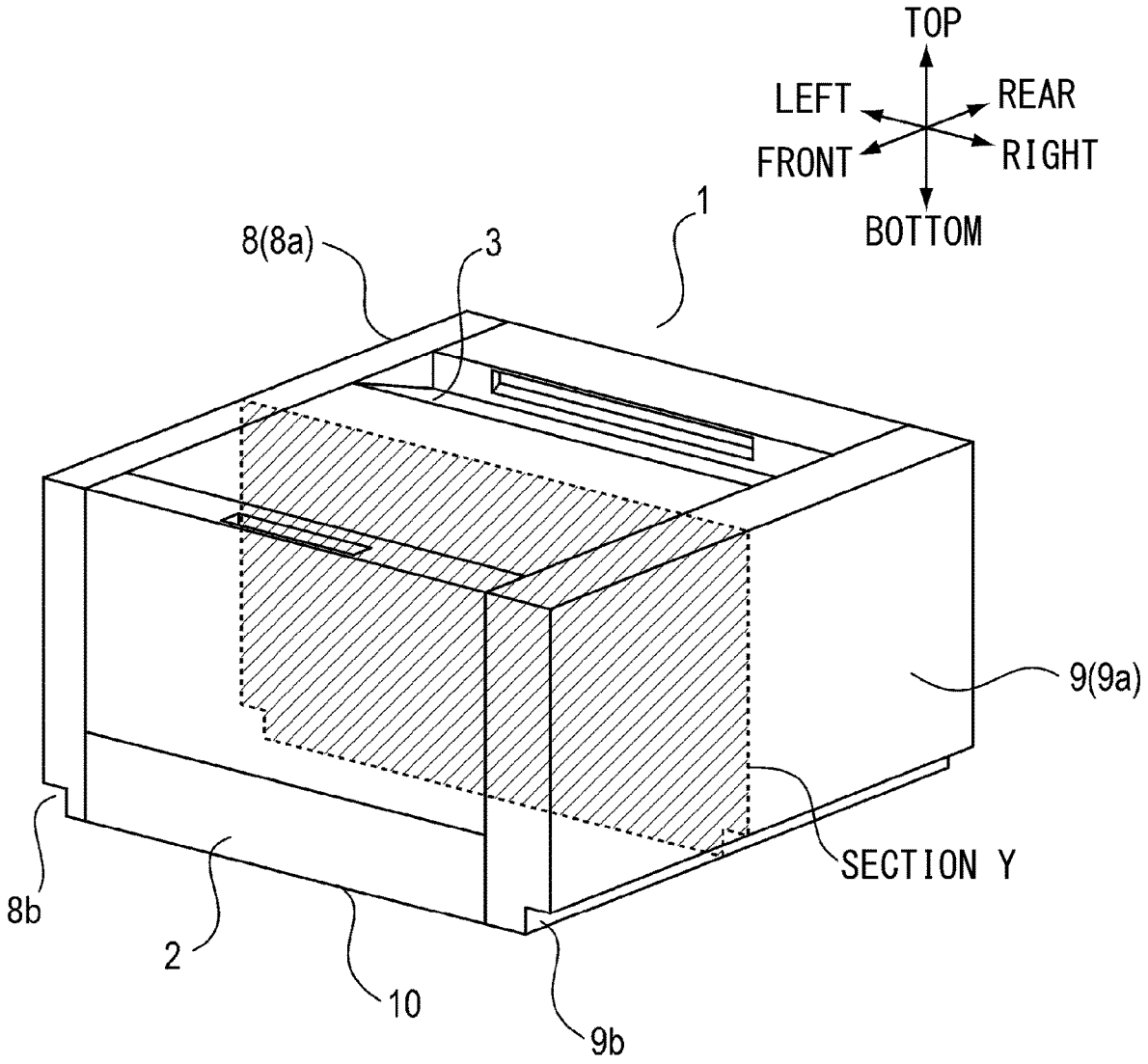
FIG. 1 is a perspective view of an image forming apparatus according to an embodiment.
Figure 9:
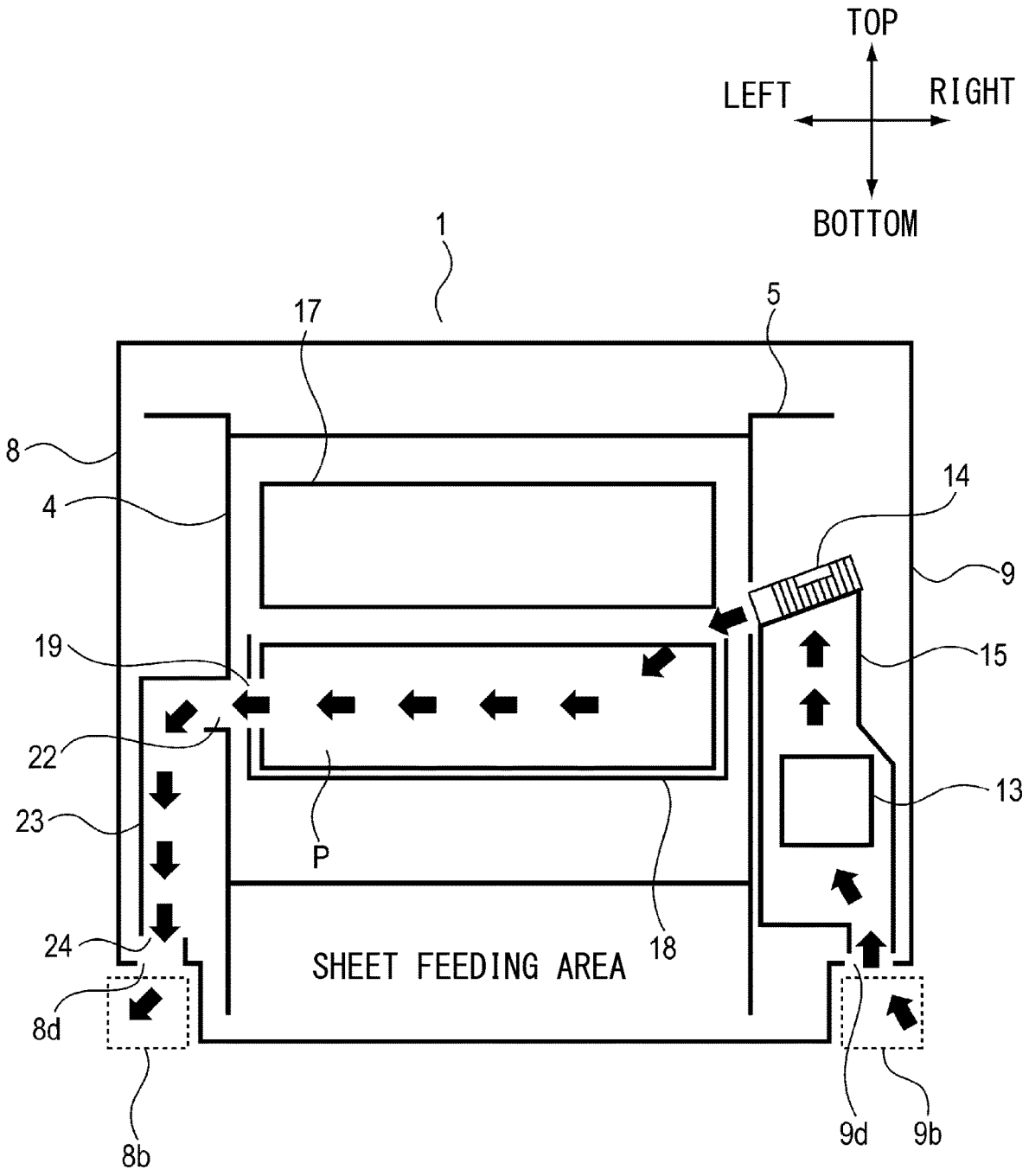

FIG. 9 is a schematic view of the image forming apparatus when a cross section Y with respect to a left-right direction in FIG. 1 is seen from a front (surface) side.

Figure 10:
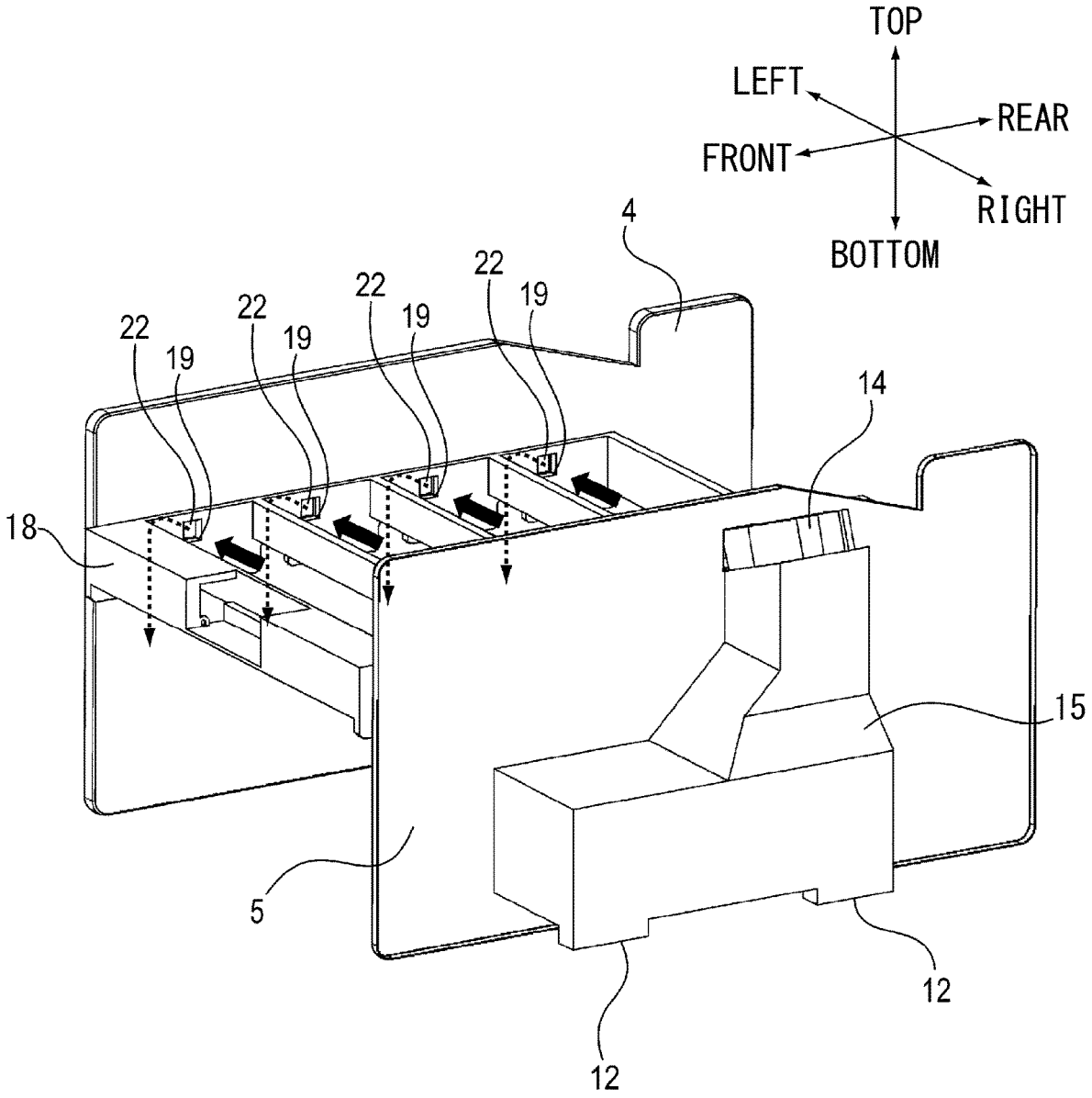

FIG. 10 is a perspective view of an air blowing passage of an image forming apparatus according to another embodiment in a state in which an outer casing cover is not shown.

DESCRIPTION OF THE EMBODIMENTS

In the following, embodiments of an image forming apparatus according to the present invention will be described with reference to the drawings. In the following description, as regards dimensions, materials, shapes and relative arrangement of constituent elements, the scope of the present invention is not intended to be limited to those described below unless otherwise specified.

Embodiment 1

The image forming apparatus according to the present invention will be described using FIGS. 1 to 9. In this embodiment, a printer is illustrated as the image forming apparatus. FIG. 1 is a perspective view of an image forming apparatus 1 according to this embodiment. Part (a) of FIG. 2 is a perspective view of the image forming apparatus 1 as seen from a lower left side, and part (b) of FIG. 2 is a perspective view of the image forming apparatus 1 as seen from a lower right side. FIG. 3 is a perspective view of the image forming apparatus 1 in which a portion other than an offset portion is indicated by a hatched dotted line. FIG. 4 is a perspective view showing an air blowing passage of the image forming apparatus in which outer casing covers 8 and 9 shown in FIGS. 1 and 2 are not shown. FIG. 5 is a perspective view of a cartridge tray 18 holding cartridges P and a laser scanner unit 17. FIG. 6 is a perspective view of the cartridge P. FIG. 7 is a schematic view of the cartridges P and the laser scanner unit 17. FIG. 8 is a perspective view of the air blowing passage of the image forming apparatus 1 in which the outer casing covers 8 and 9 are not shown. FIG. 9 is a schematic view of the image forming apparatus 1 when a cross section Y with respect to a left-right direction in FIG. 1 is seen from a front (surface) side.

As shown in FIG. 1, in the image forming apparatus 1, a cassette 2 in which a sheet as a recording material (medium) is stacked and accommodated is mounted so as to be capable of being pulled out. In the image forming apparatus 1, the sheet stacked in the cassette 2 is not illustrated, but is supplied to an image forming portion for forming an unfixed image, and then the unfixed (image) is transferred at a transfer portion. The sheet on which the unfixed image is formed is further supplied to a downstream side, and the unfixed image is fixed on the sheet at the fixing portion by heat and pressure, so that the sheet is discharged onto a discharge stacking tray 3 on an outside of the image forming apparatus 1.

In the following description, with respect to the image forming apparatus 1, a front side (front surface side) refers to a side where the cassette 2 is pulled out of the image forming apparatus 1, and a rear side (rear surface side) refers to a side opposite from the front side. Further, left and right refer to those in the case where the image forming apparatus 1 is seen from the front side. Further, upper and lower refer to those in the case where the image forming apparatus 1 is seen from the front side, and a top surface side refers to an upper side, and a bottom side opposite from the top surface side refers to a lower side.

As shown in FIG. 3, the image forming apparatus 1 includes a right side plate 5 which is a first frame member provided on one side with respect to a left-right direction which is a first direction and includes a left side plate 4 which is a second frame member provided on the other side so as to opposite the right side plate 5 with respect to the first direction. The image forming apparatus 1 includes, between the left side plate 4 and the right side plate 5 which are the frame members and which are made of metal, an image forming area 6 provided in the image forming portion (not shown) and a sheet (paper) feeding area 7 for feeding the sheet from the cassette 2 through a transfer portion and a fixing portion. The image forming area 6 between the left side plate 4 and the right side plate 5 is a space in which the image forming portion is provided. As shown in FIG. 1, the image forming apparatus 1 includes outer casing covers 8 and 9 covering the side plates 4 and 5, which oppose each other through the space. The outer casing cover 8 is provided so as to cover an outside of the left side plate 4 shown in FIG. 3. The outer casing cover 9 is provided so as to cover an outside of the right side plate 5 shown in FIG. 3.

As shown in part (a) of FIG. 2, the outer casing cover 8 includes a left side surface 8*a* which is a first side surface facing the horizontal surface with respect to one of the first direction (left-right direction), a surface 8*e* which is a second side surface facing the horizontal surface with respect to one of a second direction (front-rear direction) perpendicular to the first direction, and a surface 8*f* which is a third side surface facing the horizontal surface with respect to the other of the second direction. The outer casing cover 8 includes the left side surface (first surface) 8*a* which is a vertical surface extending in the vertical direction and an offset portion 8*b* including a second surface 8*b*1 offset in a direction from the left side surface 8*a* toward an inside of the image forming apparatus 1 and including a third surface 8*b*2 connecting the left side surface 8*a* and the second surface 8*b*1. In this embodiment, the offset portion 8*b* is provided at a bottom of the outer casing cover 8 with respect to the vertical direction. The left side surface 8*a* which is the first surface, and the second surface 8*b*1 and the third surface 8*b*2 are extended to the one surface 8*e* which is the second side surface. Further, the left side surface 8*a* which is the first surface, and the second surface 8*b*1 and the third surface 8*b*2 are extended to the other surface 8*f* which is the third side surface.

The offset portion 8*b* is constituted so that a user holds the offset portion 8*b* with his (her) hand(s) and is capable of raising the image forming apparatus 1. Specifically, as shown in part (a) of FIG. 2, the third surface 8*b*2 of the offset portion 8*b* on an upper side with respect to the vertical direction is provided with a handle portion 8*c* held by the user with his (her) hand(s) when the user raises the image forming apparatus 1. The handle portion 8*c* is a recessed portion recessed upward with respect to the vertical direction on the third surface 8*b*2 side of the offset portion 8*b*. Further, the third surface 8*b*2 of the offset portion 8*b* is provided with an air communication port 8*d* which is a through hole penetrating through the outer casing cover 8 from a top surface side to a bottom side.

As shown in part (b) of FIG. 2, the outer casing cover 9 includes a right side surface 9*a* which is a first side surface facing the horizontal surface with respect to the other of the first direction (left-right direction), a surface 9*e* which is a second side surface facing the horizontal surface with respect to one of a second direction (front-rear direction) perpendicular to the first direction, and a surface 9*f* which is a third side surface facing the horizontal surface with respect to the other of the second direction. The outer casing cover 9 includes the right side surface (first surface) which is a vertical surface extending in the vertical direction and an offset portion 9*b* including a second surface 9*b*1 offset in the direction from the right side surface 9*a* toward an inside of the image forming apparatus 1 and including a third surface 9*b*2 connecting the right side surface 9*a* and the second surface 9*b*1. In this embodiment, the offset portion 9*b* is provided at a bottom of the outer casing cover 9 with respect to the vertical direction. The right side surface 9*a* which is the first surface, and the second surface 9*b*1 and the third surface 9*b*2 are extended to the one surface 9*e* which is the second side surface. Further, the right side surface 9*a* which is the first surface, and the second surface 9*b*1 and the third surface 9*b*2 are extended to the other surface 9*f* which is the third side surface.

The offset portion 9*b* is constituted so that a user holds the offset portion 9*b* with his (her) hand(s) and is capable of raising the image forming apparatus 1. Specifically, as shown in part (b) of FIG. 2, the third surface 9*b*2 of the offset portion 9*b* on an upper side with respect to the vertical direction is provided with a handle portion 9*c* held by the user with his (her) hand(s) when the user raises the image forming apparatus 1. The handle portion 9*c* is a recessed portion recessed upward with respect to the vertical direction on the third surface 9*b*2 side of the offset portion 9*b*. Further, the third surface 9*b*2 of the offset portion 9*b* is provided with an air communication port 9*d* which is a through hole penetrating through the outer casing cover 9 from a top side to a bottom side.

As shown in FIG. 3, inside the image forming apparatus 1, a heat generating unit 13 which is a heat generating member (element) and an air blowing machine 14 for sucking the outside air into the inside of the image forming apparatus 1 are provided. The air blowing machine 14 is an air blower for blowing the air to cartridges P as objects, disposed inside the image forming apparatus 1, requiring cooling. In this embodiment, as the air blower (air blowing machine), a sirocco fan is used. The heat generating unit 13 which is the heat generating member and the air blowing machine 14 are provided on the right side plate 5 which is one of the frame members. Specifically, the heat generating unit 13 which is the heat generating member and the air blowing machine 14 are provided on an outer right side of the right side plate 5 and inside the outer casing cover 9 (FIG. 1). The air blowing machine 14 is provided in the neighborhood of the cartridges P. The air blowing machine 14 supplies the air, in a gap 31 of the cartridges P, from the right side plate 5 side toward the left side plate 4 side. Further, on a side which is an outer right side of the right side plate 5 and which an inside of the outer casing cover 9 (FIG. 1), an air suction duct 15 constituting an air blowing passage through which the air sucked through the air communication port 9*d* is supplied to a space between the right side plate 5 and the left side plate 4 is provided (FIG. 9). On a bottom side of the suction duct 15, a connecting portion 15*a* connecting the air suction duct 15 with the air communication port 9*d* provided in the offset portion 9*b* of the outer casing cover 9. On a top surface side of the air suction duct 15, the air blowing machine 14 for sucking the outside air into the inside of the image forming apparatus 1 through the air communication port 9*d* is provided. The air blowing machine 14 is connected to the top surface side of the air suction duct 15. Inside the air suction duct 15, the heat generating unit 13 is provided. That is, the heat generating unit 13 is provided inside the air suction duct 15 and is covered with the air suction duct 15. The heat generating unit 13 is disposed inside the air suction duct 15 between the air blowing machine 14 connected to the top surface side of the air suction duct 15 and the air communication port 9*d* connected to the connecting portion 15*a* on the bottom side of the air suction duct 15.

As shown in FIG. 4, in the image forming area 6 (FIG. 3) between the left side plate 4 and the right side plate 5, the image forming portion is disposed. In the image forming portion disposed in the image forming area 6, the plurality of cartridges P which are objects requiring cooling by the air blowing machine 14 are disposed and arranged in a line along the front-rear direction. In this embodiment, as shown in FIGS. 4 and 5, four cartridges P are held by the cartridge tray 18 is provided between the right side plate 5 and the left side plate 4 which are the frame members. The cartridge tray 18 is a holding member for holding the respective cartridges P so as to be mountable in and dismountable from the image forming apparatus, and the plurality of (four) cartridges P are provided so as to be movable relative to the image forming apparatus in an arrangement direction (front-rear direction) in which the cartridges P are arranged in the line. Above the respective cartridges P, the laser scanner unit 17 is disposed. The laser scanner unit 17 irradiates each of photosensitive drums 33 with laser light through the associated one of the gaps 31 of the cartridges P.

As shown in FIG. 7, each cartridge P which is the object requiring cooling includes a drum container 35 provided with the photosensitive drum 33 and a developing container 34 provided with a developing roller (not shown) for developing an electrostatic latent image formed on the photosensitive drum 33. In each cartridge P, the gap 31 through which the laser light passes toward the photosensitive drum 33 is a space defined by the developing container 34, the drum container 35 and the photosensitive drum 33. The gap 31 is provided from the side of the right side plate 5 which is one frame member to the side of the left side plate 4 which is the other frame member. That is, as shown in FIG. 6, the gap 31 is provided over a longitudinal direction (left-right direction) of each cartridge P and constitutes an air blowing passage along which the air supplied from one side of the longitudinal direction (left-right direction) of each cartridge P passes through the gap 31 toward the other side of the longitudinal direction.

As shown in FIG. 4, the right side plate 5 is provided with a cartridge duct 20 for supplying the air, supplied from the air blowing machine 14, to the respective cartridges P. The cartridge duct 20 includes air blowing parts 21 at positions corresponding to the gaps 31 of the cartridges P. Inside the cartridge duct 20, partition walls (not shown) for equally distributing the air, supplied from the air blowing machine 14, to the respective cartridges P are provided. The air supplied from the air blowing machine 14 and is equally distributed inside the cartridge duct 20 and then is supplied through the respective air blowing ports 21 of the cartridge duct 20 toward the gaps 31 right above the photosensitive drums 33 of the corresponding cartridges P. The air supplied from the air blowing machine 14 to the gaps 31 of the cartridges P through the cartridge duct 20 is supplied from the side of the right side plate 5 which is one frame member toward the side of the left side plate 4 which is the other frame member in the gaps 31. That is, the air supplied from the air blowing machine 14 to the gaps 31 of the cartridges P is supplied from one side to the other side of the first direction in the gaps 31. Here, the first direction is the above-described left-right direction and is an air blowing direction in which the air is supplied from the side of the right side plate 5 which is one frame member toward the side of the left side plate 4 which is the other frame member.

As shown in FIG. 9, the cartridge tray 18 holding the cartridges P is provided with tray air discharge ports 19 which are first openings through which the air supplied from the air blowing machine 14 through the gaps 31 are supplied on the other side (the left side plate 4 side) of the air blowing direction. Each of the tray air discharge ports 19 (FIG. 5) is provided in the left side surface of the cartridge tray 18, and is the first opening partially overlapping with a part of the associated gap 31 of the cartridge P with respect to the air blowing direction. Further, the left side plate 4 is provided with side plate air discharge ports 22 which are second openings at positions overlapping with the associated tray air discharge ports 19 with respect to the air blowing direction. Each of the side plate air discharge ports 22 is provided in the left side plate 4 which is the other frame member, and is the second opening provided at the position where the side plate air discharge port 22 opposes the associated tray air discharge port 19 with respect to the air blowing direction which is the first direction. Further, outside the left side plate 4, air discharging ducts 23 which are air discharging passage members to which the air supplied through the side plate air discharge ports 22 is guided are provided. The air discharging ducts 23 are provided for the side plate air discharge ports 22, respectively, corresponding to the cartridges P and are provided as separate members, but may also be constituted as an integral member. In this case, similarly as the cartridge duct 20, the air discharging ducts 23 are provided as an integrated air discharging passage member provided with a plurality of air discharge ports corresponding to the cartridges P, respectively, and a constitution in which the air supplied inside the duct is distributed to each of the respective air discharge ports by partition walls is employed.

As shown in FIG. 4, each air discharging duct 23 is provided with an air discharge port 24. On the other hand, the outer casing cover 8 provided so as to cover an outside of the left side plate 4 through the air discharging duct 23 is configured so as to be capable of discharging the air, supplied through the air discharging duct 23, to an outside of the image forming apparatus 1. Specifically, as shown in FIG. 9, the air communication port 8*d* provided on the top surface side (third surface 8*b*2 side) of the offset portion 8*b* of the outer casing cover 8 corresponds to the air discharge port 24 provided in each of the air discharging ducts 23. Accordingly, the air discharged through the air discharge port 24 of the air discharging duct 23 passes through the air communication port 8*d* of the outer casing cover 8 and thus is discharged to the outside of the image forming apparatus 1.

Next, a flow of the air in the image forming apparatus 1 according to this embodiment will be described using FIGS. 4 to 9. Incidentally, arrows shown in FIG. 9 represent an air passage which is the flow of the air discharged through the air communication port 8*d* via the image forming area. In the image forming apparatus 1 according to this embodiment, the air communication port 9*d* provided at the offset portion 9*b* of the outer casing cover 9 is used as an air suction port for permitting suction of the air from the outside to the inside of the image forming apparatus 1. Further, the air communication port 8*d* provided at the offset portion 8*b* of the outer casing cover 8 is used as an air discharge port for permitting discharge of the air from the inside to the outside of the image forming apparatus 1.

As shown in FIG. 9, the air blowing machine 14 provided inside the image forming apparatus 1 operates, so that the air outside the image forming apparatus 1 is sucked into the image forming apparatus 1 through the air communication port (air suction port) 9*d* provided at the offset portion 9*b* of the outer casing cover 9. The sucked air is supplied to the inside of the air suction duct 15 through the connecting portion 15*a* provided on the air suction duct 15.

The air sucked inside the air suction duct 15 is sucked by the air blowing machine 14 via the heat generating unit 13 disposed inside the air suction duct 15. At this time, the heat generating unit 13 is cooled by the air flowing through the inside of the air suction duct 15. Incidentally, in this embodiment, the air suction duct 15 is provided as a separate member from the outer casing cover 9, but a constitution in which a part of the outer casing cover 9 functions as the air suction duct 15 constituting an air blowing passage may also be employed.

The air supplied from the air blowing machine 14 is supplied to the cartridge duct 20 for supplying the air to the respective cartridges P. Inside the cartridge duct 20, the air supplied from the air blowing machine 14 is equally distributed to the respective cartridges P. The air equally distributed inside the cartridge duct 20 is supplied toward the gaps 31 right above the photosensitive drums 33 of the cartridges P through the air blowing ports 21 corresponding to the cartridges P, respectively.

Incidentally, an air flow rate of the air supplied from the air blowing machine 14 and flowing through the gaps 31 right above the photosensitive drums 33 through the cartridge duct 20 may preferably be 1 m/s or more.

The air blown through each of the air blowing ports 21 of the cartridge duct 20 passes through an inside of the gap 31 of the associated cartridge P and flows to an end portion opposite from the air blowing port 21 along an axial direction (left-right direction) of the photosensitive drum 33 (FIGS. 6 and 9).

The air passed through the gap 31 of the cartridge P further passes through the tray air discharge port 19 of the cartridge tray 18 and the side plate air discharge port 22 of the left side plate 4 which overlap with each other with respect to the air blowing direction, and then flows toward a left-hand outside of the left side plate 4.

The air flowed to the left-hand outside of the left side plate 4 is supplied to the associated one of the air discharging ducts 23 as shown in FIG. 9 and is changed in direction toward a bottom side of the image forming apparatus 1 along the air discharging duct 23, and then is discharged through the air discharge port 24 of the air discharging duct 23. The air discharged through the air discharge port 24 of the air discharging duct 23 is discharged to the outside of the image forming apparatus 1 through the air communication port 8*d* provided, in the offset portion 8*b* of the outer casing cover 8, correspondingly to the air discharge port 24. The offset portion 8*b* provided with the air communication port 8*d* is formed from the front side to the rear side of the outer casing cover 8, and therefore, the offset portion 8*b* forms an air discharging passage (air communication passage) from the air communication port 8*d* even when the image forming apparatus 1 is placed against the wall.

By employing the air passage constitution as described above, the air sucked into the image forming apparatus is supplied to the cartridges P which are objects requiring cooling in the image forming area and is caused to pass through the gaps 31, so that the cartridges P are cooled over the longitudinal direction. The air flowing over the longitudinal direction in each of the gaps 31 of the cartridges P passes through the cartridge tray 18 and the opening (air discharge port) of the left side plate 4 which overlap with each other with respect to the air blowing direction and then is discharged to the outside of the image forming apparatus from a lower portion of the outer casing cover 8. That is according to this embodiment, the air sucked into the image forming apparatus is supplied to the cartridges P which are the objects requiring cooling and then can be discharged to the outside of the image forming apparatus without being supplied to an unnecessary place. For that reason, a degree of a flow of the air into the sheet feeding area 7 including the fixing unit is decreases, so that it is possible to reduce a discharge amount of ultrafine particles (UFP).

In addition, the air communication port 8*d* is disposed in the offset portion 8*b* provided at the bottom of the outer casing cover 8, so that even when the image forming apparatus is placed against the wall, the air communication passage toward the air communication port can be ensured and downsizing of the image forming apparatus can also be realized.

Further, at the side surfaces 8*a* and 9*a* of the outer casing covers 8 and 9 facing one side and the other side, respectively, of the first direction, the offset portions 8*b* and 9*b* provided with the air communication ports 8*d* and 9*d*, respectively are provided and extended to one surfaces 8*e* and 9*e* and to the other surfaces 8*f* and 9*f* with respect to the second direction perpendicular to the first direction. For that reason, it is possible to ensure the air communication passages (air discharge passages) through the air communication ports even when the image forming apparatus 1 is provided against the wall.

Other Embodiments

In the above-described embodiment, a constitution in which the heat generating unit 13 was disposed inside the air suction duct 15 as shown in FIG. 3 was described as an example, but the present invention is not limited thereto. As shown in FIG. 10, a constitution in which the heat generating unit is not disposed inside the air suction duct 15 may also be employed. By employing such a constitution, a temperature of the air supplied into the image forming area between the side plates is lower than a temperature of the air in the constitution in which the heat generating unit is disposed inside the air suction duct, and therefore, an effect of enhancing cooling efficiency is achieved.

Further, in the above-described embodiment, as shown in parts (a) and (b) of FIG. 2, the offset portions 8*b* and 9*b* are provided and extended to one surfaces 8*e* and 9*e* and the other surfaces 8*f* and 9*f* with respect to the second direction perpendicular to the first direction at the left side surfaces 8*a* and 9*a* of the outer casing covers 8 and 9, but the present invention is not limited thereto. Although not illustrated, a constitution in which the offset portions are extended to the one surfaces with respect to the second direction at the side surfaces of the image forming apparatus 1 may also be employed. Or, although not illustrated, a constitution in which each of the offset portions is extended to the other side surface with respect to the second direction at the associated side surface of the image forming apparatus 1 may also be employed. That is, the constitution in which the offset portion is extended to one surface or the other surface with respect to the second direction, perpendicular to the first direction, at the side surface facing one side or the other side of the first direction of the image forming apparatus may also be employed.

Further, in the above-described embodiment, as shown in parts (a) and (b) of FIG. 2, the offset portions 8*b* and 9*b* were disposed at the bottoms of the outer casing cover 8 and 9 with respect to the vertical direction, but the present invention is not limited thereto. For example, a constitution in which the offset portions are provided at central portions of the outer casing covers, respectively, with respect to the vertical direction may also be employed.

Further, in the above-described embodiment, the right-side air communication port was used as the air suction port and the left-side air communication port was used as the air discharge port, but the present invention is not limited thereto. A constitution in which the left-side air communication port is used as the air suction port and the right-side air communication port is used as the air discharge port may also be employed. Further, a constitution in which the air blowing machine was provided on the one side plate side of the image forming apparatus was described as an example, but a constitution in which the air blowing machine is provided on both the one side plate side and the other frame member side opposing the one side plate side may also be employed.

Further, in the above-described embodiment, as the image forming apparatus, the printer was described as an example, but the present invention is not limited thereto. For example, other image forming apparatuses such as a copying machine, a facsimile machine and a multi-function machine having functions of these machines in combination may also be used. By applying the present invention to these image forming apparatuses, a similar effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-181252 filed on Oct. 1, 2019, which is hereby incorporated by reference herein in its entirety.

What is claimed is:

1. An image forming apparatus comprising:

a first frame member provided on one side in a horizontal direction;

an outer casing member configured to cover said first frame member;

a second frame member provided on the other side in the horizontal direction so as to oppose said first frame member;

a cartridge provided between said first frame member and said second frame member and including a developing roller configured to develop an electrostatic latent image;

a cartridge tray in which said cartridge is mountable and movable between said first frame member and said second frame member; and a fan disposed above said cartridge tray with respect to a height direction and disposed between said first frame member and said outer casing member;

wherein said cartridge tray is provided with an air discharge port opposing said second frame member, the air discharge port being positioned lower than said fan with respect to the height direction, and wherein said fan supplies air from a side of said first frame member toward said cartridge, the air supplied toward said cartridge being discharged from inside of said cartridge tray to outside via the air discharge port.

2. An image forming apparatus according to claim 1, wherein said outer casing member includes a first surface extending in a vertical direction, a second surface offset in a direction from said first surface toward an inside of said image forming apparatus, and a third surface connecting said first surface and said second surface, wherein said third surface is provided with an air communication port penetrating said outer casing member.

3. An image forming apparatus according to claim 2, wherein said third surface is configured so that a user is capable of holding said third surface.

4. An image forming apparatus according to claim 3, wherein said cartridge tray supports a plurality of cartridges so as to be mountable in and dismountable from said image forming apparatus, wherein said cartridge includes the plurality of cartridges provided so as to movable in an arrangement direction in which the plurality of cartridges are arranged in a line.

5. An image forming apparatus according to claim 4, wherein a plurality of the air discharge port provided in said cartridge tray are provided corresponding to the plurality of cartridges.

6. An image forming apparatus according to claim 1, wherein said first frame member is provided with a duct through which the air supplied from said fan passes.

7. An image forming apparatus according to claim 6, wherein said duct is provided with an air blowing port above said cartridge mounted on said cartridge tray to supply the air, supplied from said fan, toward said cartridge.

8. An image forming apparatus according to claim 7, wherein the air discharge port is positioned lower than the air blowing port with respect to the height direction.

9. An image forming apparatus according to claim 7, wherein said second frame is provided with a side plate air discharge port corresponding to a position of the discharge port.

10. An image forming apparatus according to claim 9, further comprising a discharging duct communicating with the side plate air discharge port, the air supplied from the side plate air discharge port being discharged to outside via the discharging duct.

* * * * *